US005431176A

United States Patent [19]

Favre

[11] Patent Number: 5,431,176

[45] Date of Patent: Jul. 11, 1995

[54] CONVERTIBLE MAKEUP CASE

[75] Inventor: Bernard Favre, Chevilly-Larue, France

[73] Assignee: Lir France S.A., Chevilly-Larue, France

[21] Appl. No.: 196,476

[22] Filed: Feb. 15, 1994

[30] Foreign Application Priority Data

Feb. 15, 1993 [FR] France ..... 93 01654

[51] Int. Cl.[6] ..... A45D 33/22

[52] U.S. Cl. ..... 132/295; 132/294

[58] Field of Search ..... 132/294, 295, 296, 301

[56] References Cited

U.S. PATENT DOCUMENTS

| | | | |
|---|---|---|---|
| 1,497,920 | 6/1924 | Lee | 132/295 |
| 1,534,871 | 4/1925 | Roystone | 132/294 |
| 1,549,276 | 8/1925 | Loesser | 132/295 |
| 1,558,471 | 10/1925 | Goertz . | |
| 1,558,492 | 10/1925 | Morrison | 132/295 |
| 1,635,941 | 7/1927 | Kendall | 132/293 X |

FOREIGN PATENT DOCUMENTS

| | | |
|---|---|---|
| 2581849 | 11/1986 | France . |
| 295604 | 1/1929 | United Kingdom . |
| 625434 | 6/1949 | United Kingdom . |

*Primary Examiner*—John G. Weiss
*Assistant Examiner*—Elise Speaks
*Attorney, Agent, or Firm*—Young & Thompson

[57] ABSTRACT

A makeup case comprising a base (1) and a closure cover (3), articulated (2) on an edge of the base (1) includes a closure (5) disposed opposite the articulation (2). The base (1) comprises a recess (8) in which is articulated, about an axle (9) parallel to the axis of articulation (2) of the cover (3) on the base (1) but spaced from the latter, one end of at least one connecting plate (11) whose other end is articulated (12) in a second base (13). The second base (13) is so disposed as to snap below the first base (1) and hide the connecting plate (11) between the two bases (1, 13).

2 Claims, 1 Drawing Sheet

CONVERTIBLE MAKEUP CASE

FIELD OF THE INVENTION

The invention relates to a makeup case of the type comprising a base and a closure cover articulated on an edge of said base, a closure being disposed opposite said articulation.

BACKGROUND OF THE INVENTION

Makeup cases of this type generally contain a grille over a shallow cup of makeup product of powder cake, as well as an applicator puff enclosed between the grille and the cover. These cases can only be used dry.

There are also known cases of the same type containing a moistenable sponge for moist use.

SUMMARY OF THE INVENTION

The present invention has for its object to permit the user of a dry makeup case to adapt it for moist use, while preserving a good appearance for the case and the conversion taking place in a simple and rapid manner at the pleasure of the user.

To this end, the case according to the invention is characterized in that said base comprises a recess in which is articulated, about an axis parallel to the axis of articulation of the cover on the base but spaced from the latter, one end of at least one connecting plate whose other end is articulated in a second base, said second base being so disposed to snap below the first base and hide said connecting plate between the two bases, said second base being adapted to contain a moistenable sponge.

The opening of the second base is effected by pressing on this second base at a point opposite the axis of articulation of the cover on the first base, which permits swinging of the connecting pin which brings the second base into inclined position permitting access to its contents, in this case a moistenable sponge. In the closed position of the assembly, which is reached by the reverse movement, the combined case has a harmonious shape because the connecting plate is not visible.

According to an embodiment of the invention, the articulation of the connecting plate on the first base is removable, such that the user can mount the second base on the initial case if she wishes, the initial case also having by itself an aesthetic shape of assembly with simply in its base the receiving hollow for the first end of the connecting plate.

In this case, it is preferably provided that the removable articulation is constituted by a fixed axle on one of the pieces, preferably the first base, and a resiliently deformable snap clasp on the other piece, preferably at the first end of the connecting pin.

BRIEF DESCRIPTION OF THE DRAWINGS

The invention will be better understood from a reading of the following description given with reference to the accompanying drawing, in which.

DETAILED DESCRIPTION OF THE INVENTION

Figure 1:
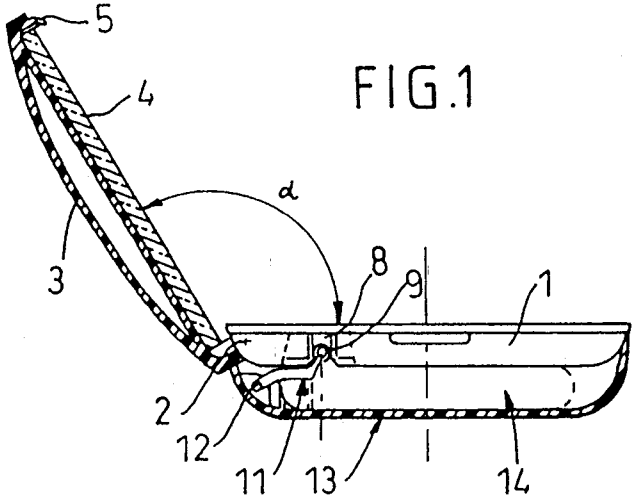
FIG. 1 is a side elevational view in cross section of a case according to one embodiment of the invention with the cover open.

The illustrated case comprises a first base 1 on which is articulated, about an axis 2, a cover 3 provided with an internal mirror 4. The cover 3 has a snap nose 5 on a resilient closure 5' of the base 1. The base 1 contains a shallow pan of makeup product 6 surmounted by a grille 7. A dry puff (not shown) is enclosed between the cover 3 and the grille 7.

Figure 2:
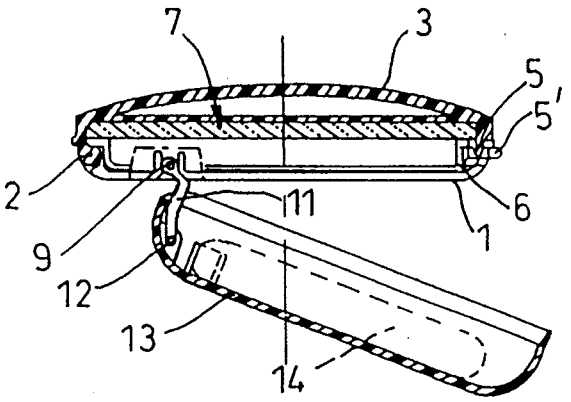
FIG. 2 is analogous to FIG. 1, but with the cover closed and the second base open.
Figure 3:
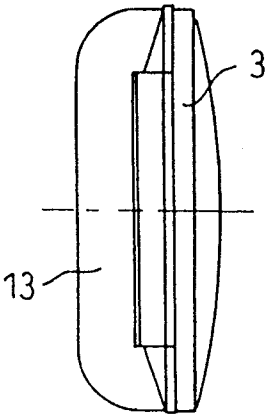
FIG. 3 is a rear elevational view of the assembly of FIGS. 1 and 2, closed.
Figure 4:
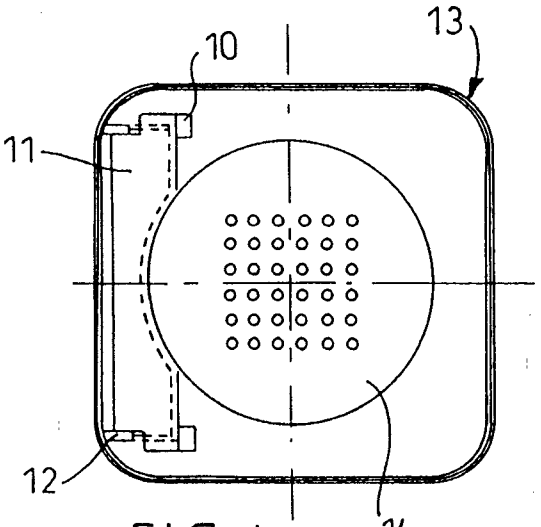
FIG. 4 is a top plan view of the second base.
Figure 5:
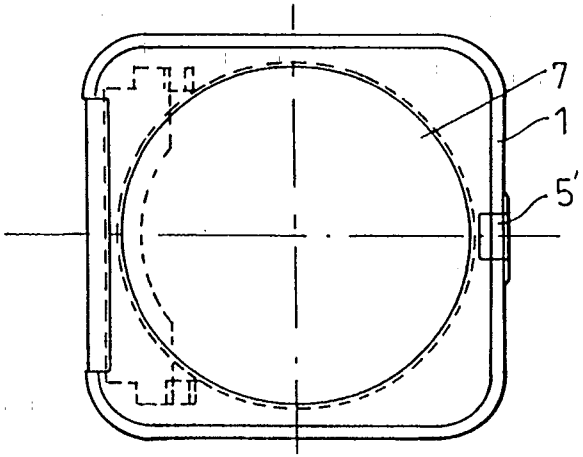
FIG. 5 is a top plan view of the first base covered by a grille.
Figure 6:
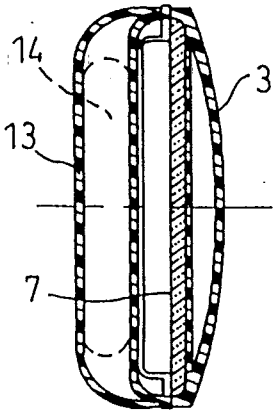
FIG. 6 is a cross-sectional view of the case at 90° relative to FIGS. 1 and 2, the case being closed.

The base 1 comprises a recess 8 in which is formed an axle 9 parallel to the axis of articulation 2. On the axle 9 are mounted pivotably two tongues 10, if desired in the form of snaps, integral with one end of a connecting plate 11 whose other end is articulated about an axle 12 parallel to the axis 2 and axle 9, within a second base 13 containing a moistenable sponge 14. The length and the curvature of the connecting plate 11 are such that the second base 13 can be snapped on the first base 1 (FIGS. 1, 3 and 6) or on the contrary can be opened to a certain angle (FIG. 2).

It will be seen in the drawing (FIG. 1) that the cover 3 opens only through an angle $\alpha$ (about 120° in the illustrated example) by abutment on the base 1. The openings of the cover 3 and of the second base 13 are independent from each other.

The use of an articulation 9, 10 that can snap together permits easily disassembly and reassembly of the second base 13 if desired by the user herself.

The connecting plate 11 can of course be replaced by two or more connecting plate.

I claim:

1. Makeup case comprising:

a first base and a closure cover, said cover articulated about an articulation axis on an edge of said first base;

a closure element on at least one of said cover and said first base, said closure element being disposed opposite to said articulation for securing said cover to said first base to form a first compartment;

a connecting plate having a first end and a second end, said first end being articulated in a recess of said first base about an axle parallel to said articulation axis but spaced therefrom;

said articulation about the axle of the connecting plate on the first base being disassembleable by an elastically deformable tongue at the first end of the connecting plate;

said connecting plate second end articulated in a second base;

said second base being so disposed as to snap to a closed position below the first base, wherein a second compartment is formed, and said connecting plate between said first and second bases is hidden.

2. Makeup case according to claim 1, wherein the first base contains a grille over a shallow pan of makeup product in a powder cake.

* * * * *